United States Patent [19]

Tredway, Sr.

[11] 4,108,441

[45] Aug. 22, 1978

[54] GOLF SWING TRAINING APPARATUS AND METHOD

[76] Inventor: Wynn B. Tredway, Sr., P.O. Box 130, Freeport, Pa. 16229

[21] Appl. No.: 767,285

[22] Filed: Feb. 3, 1977

[51] Int. Cl.[2] ..... A63B 69/36

[52] U.S. Cl. ..... 273/186 A; 273/186 C

[58] Field of Search ..... 273/186 A, 186 C, 186 D, 273/183 D; 35/29 A

[56] References Cited

U.S. PATENT DOCUMENTS

| | | | |
|---|---|---|---|
| 3,191,939 | 6/1965 | Hooper | 273/186 A |
| 3,753,564 | 8/1973 | Brandell | 273/186 A |
| 3,863,933 | 2/1975 | Tredway | 273/186 A |

FOREIGN PATENT DOCUMENTS

| | | | |
|---|---|---|---|
| 1,318,691 | 5/1973 | United Kingdom | 273/186 A |

*Primary Examiner*—George J. Marlo

*Attorney, Agent, or Firm*—Sherman H. Barber

[57] ABSTRACT

A golf swing training apparatus includes an adjustable light mounted to the head of a training golf club in such a way that when a golf pupil holds the training golf club and stands on a level surface at the address position, the club head is located substantially midway between a line that is perpendicular to the level surface from the lowest finger of the pupil's hand gripping the training club, and a vertical surface that the pupil faces. The light shines on the vertical surface at the same height above the level surface as the height of the lowest finger gripping the training club.

3 Claims, 3 Drawing Figures

GOLF SWING TRAINING APPARATUS AND METHOD

SUMMARY OF THE INVENTION

A training golf club having a head portion is fitted with an adjustable light on the head. The light is so adjusted that, when a golf pupil holds the club at the address position and faces a vertical surface, rays of light project onto the vertical surface at a height equal to the height of the bottom of the golf pupil's hands on the club above the level flat surface; the light being at the mid-point along a line from the vertical surface and a line perpendicular to the level surface from the bottom of the pupil's hands on the training golf club. Wherefore, when the training golf club is properly held at the top of the backswing, the light shines on the flat surface at a location along a line generally perpendicular to the vertical surface between a teed-up golf ball (or an imaginary golf ball) and the vertical surface.

DETAILED DESCRIPTION

The present invention is related to training apparatus and, more particularly, to golf training apparatus that indicate to a golf pupil when he has reached a proper position at the top of the backswing.

Persons who are skilled in the art know that there are many golf training apparatus that purport to aid a golf pupil in perfecting and achieving a desireable and "perfect" golf swing. Some apparatus known from the prior art are devices that include bands that surround the golf pupil's head and restrain it from any movement during the backswing and the hitting, downswing. Other devices include sound emitting devices that are attachable to a golf pupil's wrist or his right knee. Then, when the pupil takes several normal golf swings and the device does not sound, the pupil may conclude that either he has achieved the "perfect" golf swing, or he is underswinging. For one who underswings the club and does not reach the full angle with the left arm (a right handed golf pupil is assumed only for the purpose of description herein), it may be that the pupil's wrists are not cocked enough. The golf pupil then continues to increase the amount of backswing until the sound emitting device makes an audible sound.

Still, another prior art device that purports to help a golf pupil achieve that "perfect" golf swing includes a tube in which two balls are located. The balls are arranged end to end axially in the tube, and the tube is fastened to the pupil's trouser's belt. Then, when the pupil swings a golf club the tube is tilted so that one ball is released from one end of the tube and rolls down to the other end of the tube. When the rolling ball contacts the other ball, a click is heard that indicates to the golf pupil that the swing has or has not been properly carried out.

These are only a few of the many devices from the prior art that purport to tell a golf pupil when he has achieved the "perfect" golf swing. But the devices known from the prior art leave much to be desired instructionally, because the important point is the position of the golf club at the top of the backswing, and few if any devices known from the prior art say or teach anything about how the golf pupil achieves a correct position at the top of the backswing.

Those skilled in the art will recognize from the following description of one embodiment of my invention how a golf pupil can easily and without difficulty achieve a proper position of a golf club at the top of the backswing.

Figure 1:
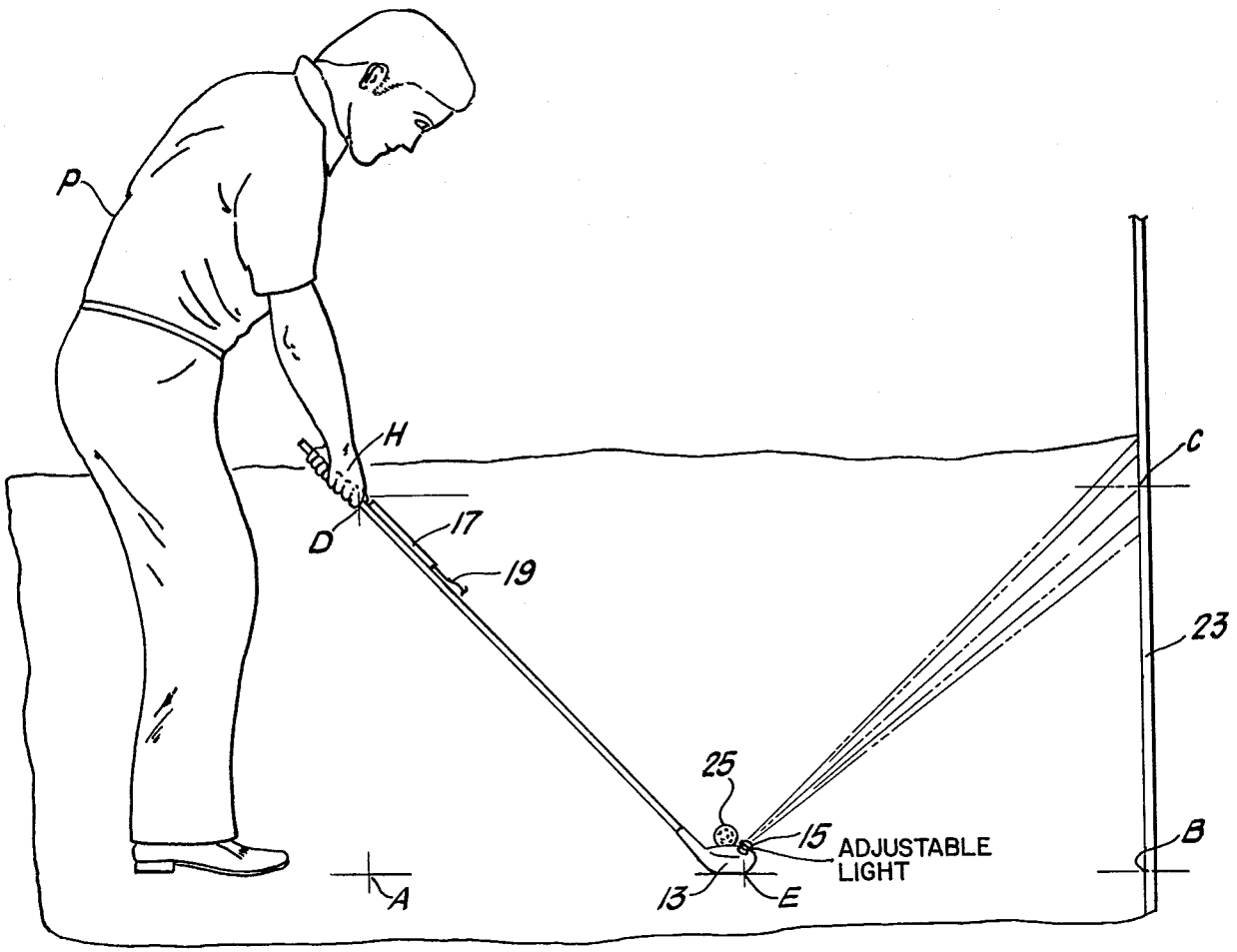
FIG. 1 is a schematic side elevational view of a golf pupil standing at the address position and holding a training golf club equipped in accordance with the present invention.

Referring to FIG. 1, a golf pupil, P, is holding a training golf club 11 at the address position and the pupil is standing on a flat level surface 21. While the training golf club shown in FIG. 1 is a wood club, it is understood that the training golf club may be an iron club instead of a wood club.

Figure 3:
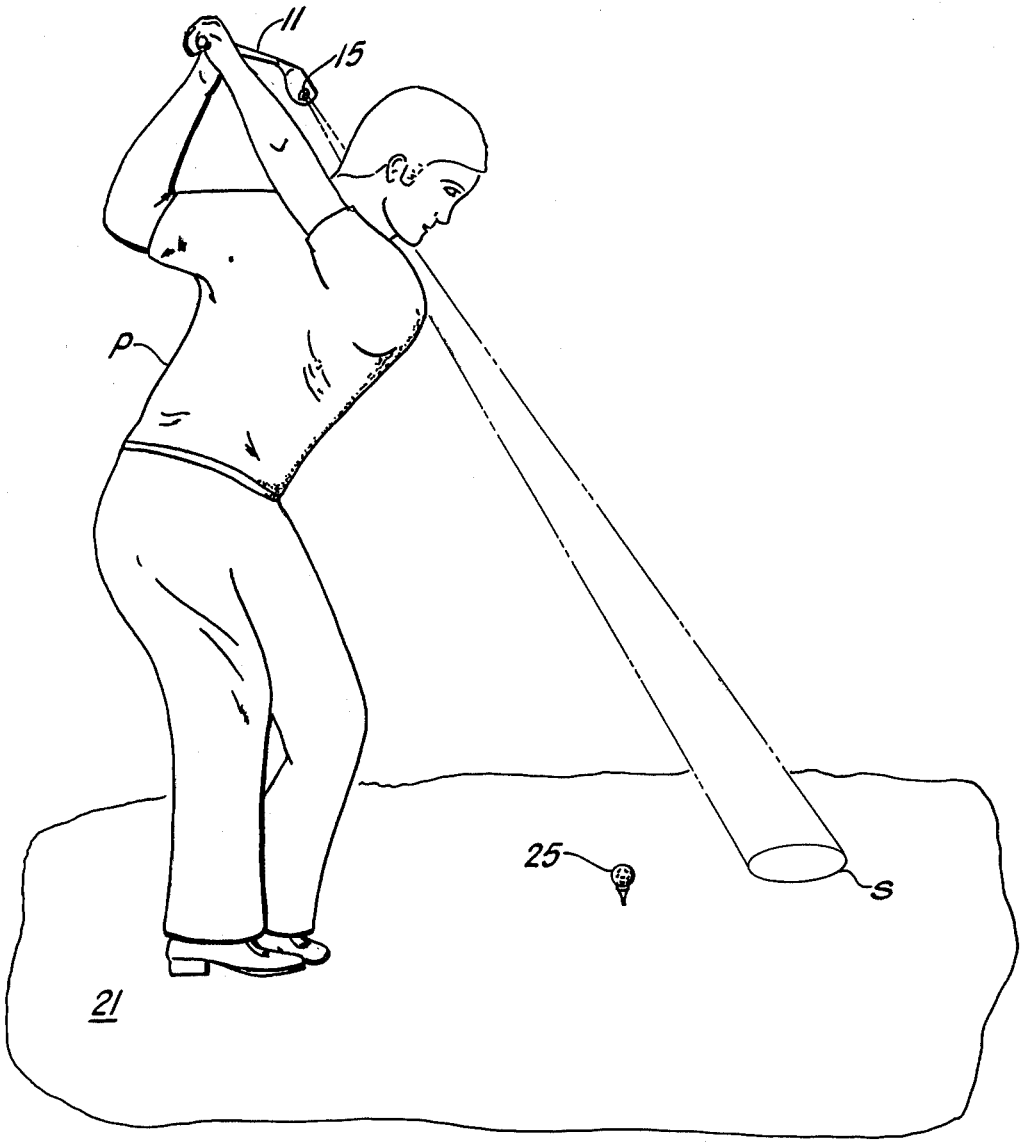
FIG. 3 is a side view of the golf pupil of FIG. 2. For a further understanding of the invention and for features and advantages thereof, reference may be had to these drawings and to the following description of an embodiment thereof that is suitable for carrying into practice the method of the invention.

The golf pupil, P, first stands at the address position while the training golf club 11, in accordance with the invention is adjusted to suit the particular physical characteristics of the pupil, P. The golf club 11, as shown in FIG. 3, has a head portion 13 that is fitted with an adjustable light 15. On the shaft portion of the training golf club 11, at a location just below the grip portion thereof, there is mounted a battery-switch assembly 17, and conventional wiring 19 connects the battery-switch assembly 17 with the light 15. In another embodiment of the invention not shown, the source of power and the light itself may be contained in a single unit adjustably mounted on the club head portion 13, as is the light 15.

The golf pupil stands on the level flat surface and holds the training golf club so that it is soled properly on the surface 21. The golf pupil faces a vertical surface 23, such as a wall or screen that is substantially parallel to the line of intended flight of a golf ball 25 (or an imaginary golf ball) teed up where shown in FIG. 1.

Then, with the golf pupil, P, poised in the proper address position, and with the training golf club head portion 13 soled properly on the flat level surface 21, the light 15 is then adjusted so that rays of light from it shine on the vertical surface 23 at point C.

The point C is at the same, or substantially the same height as point D at the bottom of the pupil's hands H as the pupil holds the training golf club 11 at the address position. A line connecting points C and D lies in a plane parallel to the plane flat level surface 21. Further, a line AD is perpendicular to the plane of the flat level surface 21, and a line BC on the vertical surface 23 is parallel to the line AD and is equal in length to such line AD. The point E where the light 15 is located is midway between points A and B. Thus, the distance AD equals BC, and the distance AE equals EB.

After the light 15 has been so adjusted, the training golf club 11 can be used in accordance with the method of the invention to correct and improve and to achieve the "perfect" golf swing.

Figure 2:
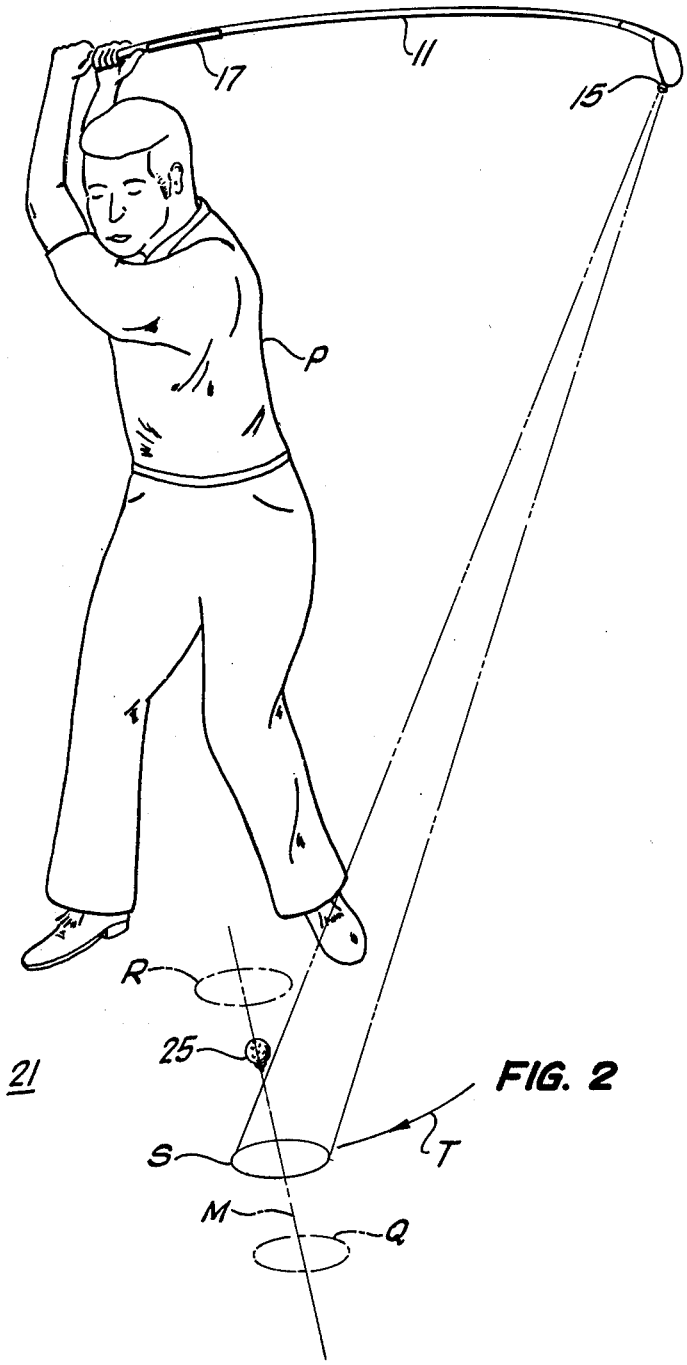
FIG. 2 is a front view of the same golf pupil in a position holding the training golf club in the proper position at the top of the backswing.

The golf pupil, P, shown in FIG. 2, has moved the training golf club 11 from the position at address through the backswing to a proper position at the top thereof. The golf pupil, P, need not be standing on the same flat level surface 21 as shown in FIG. 1, nor does he have to be standing facing the vertical surface 23 when using the training golf club in practice. After the light 15 has been properly adjusted, as described previously herein, the golf pupil may use the training golf club anywhere. It is helpful, however, if the training golf club is used in a somewhat darkened environment, because the trace, T, of the light 15 and the spots Q, R and S described hereinafter will be more apparent.

Now, in use, the golf pupil moves the training golf club through the backswing and when the club 11 nears the top of the backswing, the rays of light 15 move along the trace, T, to a spot on the surface, say the level flat surface 21.

If the rays of light shine at spot R, which is between the golf pupil's feet and the golf ball 25 (or imaginary golf ball), the golf pupil will understand that the training golf club 11 is not being held at the proper position at the top of the backswing.

The golf pupil knows then that he has not attained the "perfect" golf swing and cannot effectively hit the golf ball 25 on the through swing.

But, if the rays of light shine at spots S or Q, which spots are on the other side of the golf ball 25, away from the golf pupil's feet, the golf pupil will understand and know that he has attained the correct position at the top of the backswing from which position he can make a most effective through swing. The location of the spots S and Q may vary by being a little farther away or nearer to the golf ball 25 (or imaginary golf ball) and they may be a small distance on either side of the line M connecting the spots R, S and Q shown in FIG. 1. But the the spot where the light shines must not be between the golf ball 25 and the golf pupil's feet.

From the foregoing description of one embodiment of my invention those skilled in the art will recognize many important features and advantages among which the following are particularly significant:

That the apparatus and the method of use thereof quickly show the golf pupil when he achieves the "perfect" golf swing, since he knows and can see an indication of the training golf club held in the correct position at the top of the backswing;

That the golf pupil and a golfer obtain a visual indication and feel of the correct swing which otherwise is only an optical illusion that can never be obtained from following or aping pictures in a book;

That the golf pupil, either with or without guidance from an instructor such as a golf pro, can use my invention and after diligent practice improve his golf swing and achieve the "perfect" golf swing; and That by using the apparatus of my invention and achieving the proper position of the training golf club at the top of the backswing, the golf pupil knows that he only needs to uncoil his body and make the correct through swing to achieve the maximum effective power when he strikes the golf ball.

Although the invention has been described herein with a certain degree of particularity, it is understood that the disclosure thereof has been made only as an example, and that the scope of my invention is defined by what is hereafter claimed.

What is claimed is:

1. The combination comprising:

(a) a training golf club having a head portion; and (b) a light adjustably mounted to said head portion in such a way that, when said traning golf club is held at a proper position at the top of the backswing by a golf pupil addressing a golf ball or an imaginary golf ball, a beam of light from said light shines along a line extending away from said golf ball or imaginary golf ball and normal to the intended flight path of said golf ball or imaginary golf ball.

2. A method for indicating to a golf pupil standing on a level surface and holding a training golf club when he holds it at a proper position at the top of the backswing, comprising:

(a) adjusting a light mounted to the head portion of said training golf club in such a way that when said club is held at a porper position at the top of the backswing a beam of light from said light shines on said level surface at a spot beyond a golf ball or imaginary golf ball and along a line normal to the intended flight path of said golf ball or imaginary golf ball.

3. The method indicating the proper position of a training golf club at the top of the backswing comprising:

(a) establishing a vertical surface normal to a level surface at a preselected distance from a golf ball to be addressed on said level surface;

(b) facing said vertical surface and soling the head portion of said training golf club on said level surface behind said golf ball;

(c) adjusting an electric light mounted on said head portion in such a way that a light beam therefrom shines on said vertical surface at a spot that is the same height above said level surface at the lowest fingers of the hands of a person holding said training golf club; and (d) swinging said training golf club through the backswing to the top position in such a way that at the top position said beam from said light shines on said level surface at a location along a line normal to said vertical surface and extending between said vertical surface and said golf ball.

* * * * *